US010269321B2

(12) United States Patent
Yoon et al.

(10) Patent No.: US 10,269,321 B2
(45) Date of Patent: Apr. 23, 2019

(54) DISPLAY DEVICE USING SUB-PIXELS TO INCREASE VIEWING ANGLE

(71) Applicant: SAMSUNG DISPLAY CO., LTD., Yongin-si, Gyeonggi-Do (KR)

(72) Inventors: Jihee Yoon, Asan-si (KR); Kang-woo Kim, Seoul (KR); Beomjun Kim, Seoul (KR); Jonghwan Lee, Asan-si (KR); Hong-woo Lee, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 73 days.

(21) Appl. No.: 15/470,968

(22) Filed: Mar. 28, 2017

(65) Prior Publication Data

US 2017/0287432 A1 Oct. 5, 2017

(30) Foreign Application Priority Data

Mar. 29, 2016 (KR) ..... 10-2016-0037883

(51) Int. Cl.
*G09G 3/36* (2006.01)
*G09G 3/20* (2006.01)

(52) U.S. Cl.
CPC ..... *G09G 3/3696* (2013.01); *G09G 3/2074* (2013.01); *G09G 3/3614* (2013.01);
(Continued)

(58) Field of Classification Search
CPC .. G09G 3/3696; G09G 3/2074; G09G 3/3614; G09G 3/3659; G09G 3/3677;
(Continued)

(56) References Cited

U.S. PATENT DOCUMENTS

2008/0055293 A1* 3/2008 Kuo ..... G09G 3/3648 345/204
2008/0246038 A1* 10/2008 Um ..... G02F 1/13624 257/72

(Continued)

FOREIGN PATENT DOCUMENTS

| | | |
|---|---|---|
| KR | 10-0997974 | 12/2010 |
| KR | 10-2012-0053159 | 5/2012 |
| KR | 10-1497494 | 3/2015 |

*Primary Examiner* — Lisa S Landis
(74) *Attorney, Agent, or Firm* — F. Chau & Associates, LLC

(57) ABSTRACT

A display device includes a display panel having a plurality of pixels respectively connected to a plurality of gate lines and a plurality of data lines, a gate driving circuit that outputs a plurality of gate signals to the plurality of gate lines, and a data driving circuit configured that outputs a plurality of data signals for driving the plurality of data lines. Each of the plurality of pixels includes a first sub-pixel configured to receive a corresponding data signal among the plurality of data signals in response to a first gate signal among the plurality of gate signals, and a second sub-pixel configured to receive a corresponding data signal among the plurality of data signals in response to the first gate signal, and reduce a voltage of the received data signal in response to a second gate signal among the plurality of gate signals. The second gate signal is a signal delayed by a 2×d×H time relative to the first gate signal (where each of d and H is a positive integer, H is a horizontal period, and d×H is a pulse width of first and second gate signals).

7 Claims, 10 Drawing Sheets

(52) U.S. Cl.
CPC ..... *G09G 3/3659* (2013.01); *G09G 3/3677* (2013.01); *G09G 3/3688* (2013.01); *G09G 2300/0852* (2013.01); *G09G 2310/0205* (2013.01)

(58) Field of Classification Search
CPC ..... G09G 3/3688; G09G 2300/0852; G09G 2310/0205
See application file for complete search history.

(56) References Cited

U.S. PATENT DOCUMENTS

2013/0120469 A1* 5/2013 Tien ..... G09G 3/3648 345/690
2014/0049619 A1* 2/2014 Hsieh ..... G02F 1/136286 348/51

* cited by examiner

| | Driving Condition | | Gi+3 | | Gi+4 | |
|---|---|---|---|---|---|---|
| | Node | | Na | Nb | Na | Nb |
| Voltage(V) | Positive Polarity | Pi | 11.61 | 11.60 | 11.61 | 11.61 |
| | | Pi+2 | 9.83 | 10.21 | 9.83 | 9.90 |
| | | Pi+4 | 9.93 | 12.91 | 9.93 | 12.61 |
| | | Pi+6 | 9.88 | 9.67 | 9.87 | 9.32 |
| | Negative Polarity | Pi | 4.65 | 4.65 | 4.65 | 4.65 |
| | | Pi+2 | 3.09 | 3.42 | 3.08 | 3.09 |
| | | Pi+4 | 3.19 | 8.02 | 3.18 | 7.71 |
| | | Pi+6 | 3.14 | 4.58 | 3.13 | 4.22 |

DISPLAY DEVICE USING SUB-PIXELS TO INCREASE VIEWING ANGLE

CROSS-REFERENCE TO RELATED APPLICATION

This U.S. non-provisional patent application claims priority under 35 U.S.C. § 119 from Korean Patent Application No. 10-2016-0037883, filed on Mar. 29, 2016, which is incorporated by reference herein.

TECHNICAL FIELD

The present disclosure herein relates to a display device.

DISCUSSION OF THE RELATED ART

A display device includes a plurality of gate lines, a plurality of data lines, and a plurality of pixels connected to the plurality of gate lines and the plurality of data lines. The display device includes a gate driving circuit for sequentially providing gate signals to the plurality of gate lines and a data driving circuit for outputting data signals to the plurality of data lines. The display device includes a Liquid Crystal display (LCD), a Plasma Display Panel (PDP), and an Organic Light Emitting Diode Display (OLED).

In the case of an LCD device, the breadth of the viewing angle is a factor that determines display quality LCDs, liquid crystals, pixel structures, and driving methods, which are capable of achieving a wide viewing angle, have been developed. A wide viewing angle may be achieved by forming two or more sub-pixels at one pixel and applying a different data voltage to each sub-pixel to arrange liquid crystal molecules in each sub-pixel in different directions. In this case, when each sub-pixel in one pixel is connected to a different data line to be driven or connected to a different gate line to apply a different data voltage to each sub-pixel, the numbers of gate lines and data lines in the entire LCD are increased so that the aperture ratio of each pixel decreases and the number of driving circuits increases. As a result, the manufacturing cost of an LCD may increase.

SUMMARY

The present disclosure provides a display device with extended lateral visibility and reliability. An embodiment of the inventive concept provides a display device including: a display panel comprising a plurality of pixels respectively connected to a plurality of gate lines and a plurality of data lines; a gate driving circuit configured to generate a plurality of gate signals to the plurality of gate lines; and a data driving circuit configured to generate a plurality of data signals to drive the plurality of data lines, wherein each of the plurality of pixels comprises at least two sub-pixels in which a first sub-pixel is configured to receive a corresponding data signal among the plurality of data signals in response to a first gate signal output by the gate driving circuit, and a second sub-pixel is configured to receive a corresponding data signal among the plurality of data signals in response to the first gate signal, and reduce a voltage of the received data signal in response to a second gate signal output by the gate driving circuit, wherein the second gate signal is delayed by a 2×d×H time relative to the first gate signal, where d and H are positive integers, H is a horizontal period, and d×H is a pulse width of the first gate signal and the second gate signal.

In an embodiment of the inventive concept, when a pulse width of the first gate signal and the second gate signal is 2×H, if the first gate signal is an i-th gate signal among the plurality of gate signals, the second gate signal may be an (i+4)th gate signal.

In an embodiment of the inventive concept, the first sub-pixel may include: a first switching transistor including a first electrode connected to a corresponding data line among the plurality of data lines, a second electrode connected to a first node, and a gate electrode connected to a corresponding first gate line among the plurality of gate lines; a first liquid crystal capacitor connected between the first node and a common electrode for receiving a common voltage; and a first storage capacitor connected between the first node and a storage electrode for receiving a storage voltage.

In an embodiment of the inventive concept, the second sub-pixel may include: a second switching transistor including a first electrode connected to a corresponding data line among the plurality of data lines, a second electrode connected to a second node, and a gate electrode connected to a corresponding first gate line among the plurality of gate lines; a second liquid crystal capacitor connected between the second node and a common electrode for receiving a common voltage; a second storage capacitor connected between the second node and a storage electrode for receiving a storage voltage; a third switching transistor including a first node connected to the second node, a second electrode connected to a third node, and a gate electrode connected to a second gate line among the plurality of gate lines; and a pull-down capacitor connected between the third node and the storage electrode.

In an embodiment of the inventive concept, when a pulse width of the first gate signal and the second gate signal is 2×H, if the first gate line is an i-th gate line among the plurality of gate lines, and the second gate line may be an (i+4)th gate line.

In an embodiment of the inventive concept, when a pulse width of the first gate signal and the second gate signal is 4×H, if the first gate line is an i-th gate line among the plurality of gate lines, and the second gate line may be an (i+8)th gate line.

In an embodiment of the inventive concept, a driving controller outputs control signals to the gate driving circuit and the data driving circuit based on received image data.

In an embodiment of the inventive concept, the driving controller receives image data and corresponding command signals from an external graphic control unit.

In an embodiment of the inventive concept, a display device includes: a display panel including a plurality of pixels respectively connected to a plurality of gate lines and a plurality of data lines; a gate driving circuit configured to generate a plurality of gate signals output to the plurality of gate lines and output a plurality of carry signals corresponding to the plurality of gate signals; and a data driving circuit configured to generate a plurality of data signals for driving the plurality of data lines, wherein each of the plurality of pixels includes: a first sub-pixel configured to receive a corresponding data signal among the plurality of data signals in response to a corresponding first gate signal among the plurality of gate signals; and a second sub-pixel configured to receive a corresponding data signal among the plurality of data signals in response to the first gate signal, and reduce a potential (e.g. voltage) of the received data signal in response to a first carry signal corresponding to the first gate signal among the plurality of carry signals.

In an embodiment, the first carry signal may be a carry signal corresponding to a gate signal delayed by a d×H+1 time than the first gate signal (where each of d and H is a positive integer, H is a horizontal period, and d×H is a pulse width of a gate signal).

In an embodiment, when a pulse width of the first gate signal is 2H (where H is a horizontal period), if the first gate signal is an i-th gate signal among the plurality of gate signals, the first carry signal may be an (i+3)th carry signal among the plurality of carry signals.

In an embodiment, the first sub-pixel may include: a first switching transistor including a first electrode connected to a corresponding data line among the plurality of data lines, a second electrode connected to a first node, and a gate electrode may be connected to a corresponding first gate line among the plurality of gate lines; a first liquid crystal capacitor may be connected between the first node and a common electrode for receiving a common voltage; and a first storage capacitor may be connected between the first node and a storage electrode for receiving a storage voltage.

In an embodiment, the second sub-pixel may include: a second switching transistor including a first electrode connected to a corresponding data line among the plurality of data lines, a second electrode connected to a second node, and a gate electrode may be connected to a corresponding first gate line among the plurality of gate lines; a second liquid crystal capacitor may be connected between the second node and a common electrode for receiving a common voltage; a second storage capacitor connected between the second node and a storage electrode for receiving a storage voltage; a third switching transistor including a first node connected to the second node, a second electrode connected to a third node, and a gate electrode for receiving a first carry signal among the plurality of carry signals; and a pull-down capacitor may be connected between the third node and the storage electrode.

In an embodiment, the gate driving circuit includes a plurality of driving stages in a cascaded arrangement in which one or more driving stages operates in response to a received carry signal outputted from a previous stage and a carry signal outputted from the next stage in the cascaded arrangement.

In an embodiment, a display panel may include a plurality of pixels respectively connected to a plurality of gate lines to output respective gate signals and a plurality of data lines to output respective data signals, and in which each pixel is comprised of at least a first sub-pixel and a second sub-pixel that face each other with a first gate line arranged therebetween. The first sub-pixel is configured to receive a corresponding data signal among a plurality of data signals in response to a first gate signal through the first gate line, and the second sub-pixel configured to receive a corresponding data signal among the plurality of data signals in response to the first gate signal, and reduce a voltage of the received data signal in response to a second gate signal received through a second gate line.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Hereinafter, embodiments of the inventive concept are described in more detail with reference to the accompanying drawings.

Figure 1:
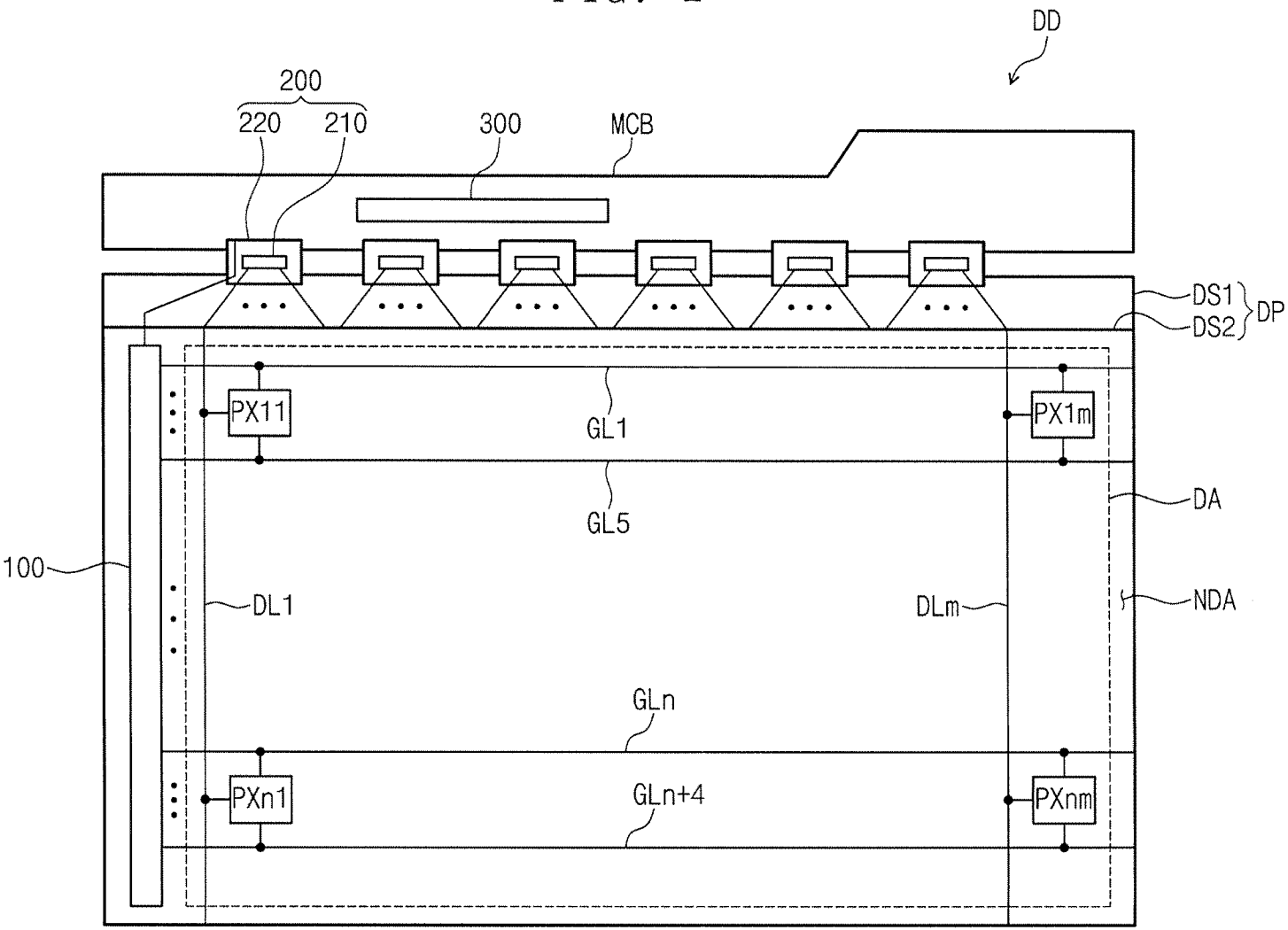
FIG. 1 is a plan view illustrating a display device according to an embodiment of the inventive concept.
Figure 2:
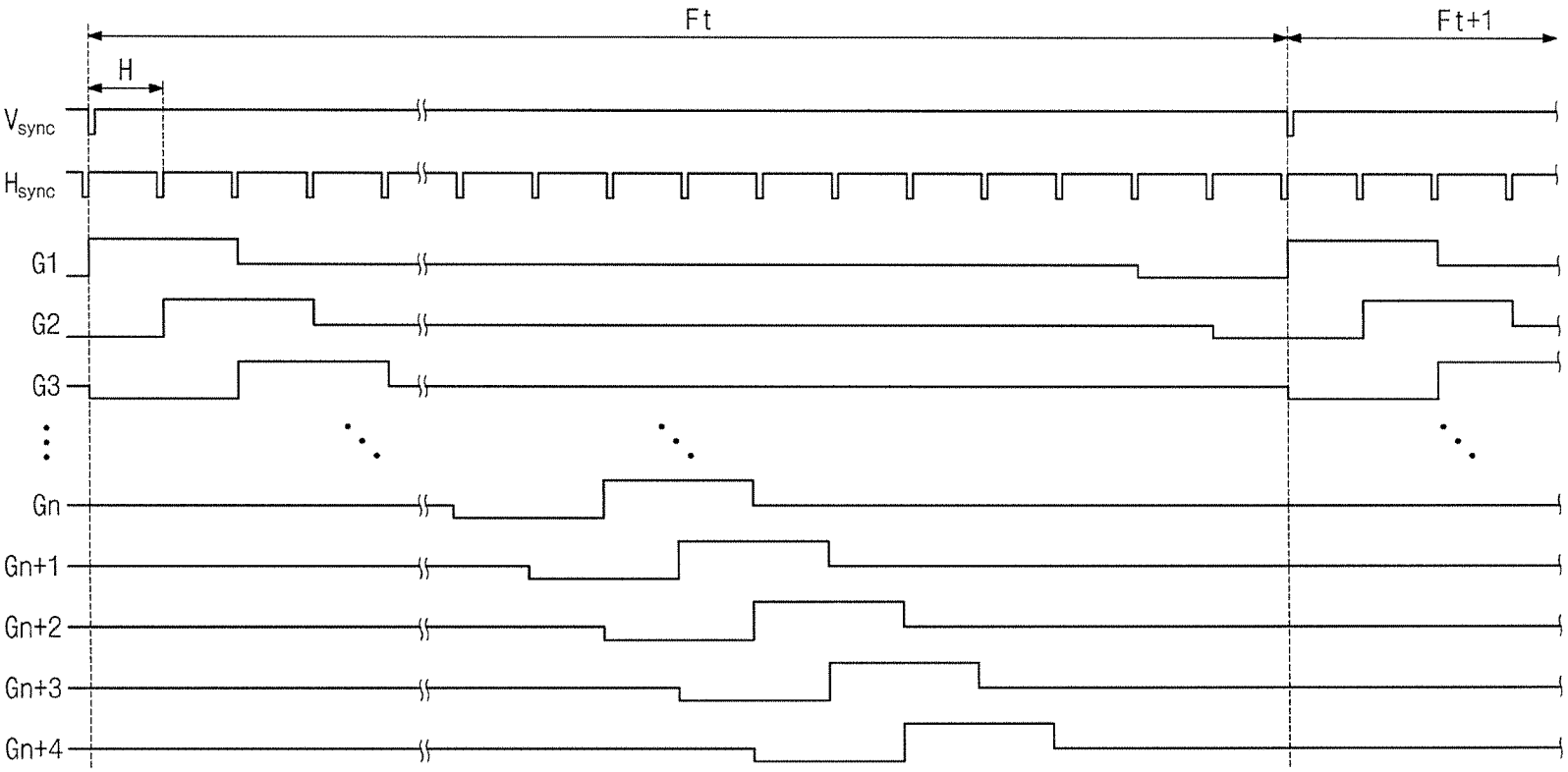
FIG. 2 is a timing diagram illustrating signals of a display device according to an embodiment of the inventive concept.

FIG. 1 is a plan view illustrating a display device according to an embodiment of the inventive concept. FIG. 2 is a timing diagram illustrating signals of a display device according to an embodiment of the inventive concept.

As shown in FIGS. 1 and 2, a display device DD according to an embodiment of the inventive concept may include a display panel DP, a gate driving circuit 100, a data driving circuit 200, and a driving controller 300.

The display panel DP is not limited to a specific type of construction, and for example, may include various types of display panels such as a liquid crystal display panel, an organic light emitting display panel, an electrophoretic display panel, and an electrowetting display panel. In the embodiment shown in FIGS. 1 and 2, the display panel DP is a liquid crystal display panel. On the other hand, a liquid crystal display device including a liquid crystal display panel may further include, for example, a polarizer (not shown) and a backlight unit (not shown).

The display panel DP may include a first substrate DS1, a second substrate DS2 spaced apart from the first substrate DS1, and a liquid crystal layer LCL disposed therebetween. The face of the display panel DP includes a display area DA where a plurality of pixels PX11 to PXnm may be arranged, and may include a non-display area NDA surrounding the display area DA.

The display panel DP includes a plurality of gate lines GL1 to GLn+4 disposed on the first substrate DS1 and a plurality of data lines DL1 to DLm intersecting the plurality of gate lines GL1 to GLn+4. The plurality of gate lines GL1 to GLn+4 may be connected to the gate driving circuit 100. The plurality of data lines DL1 to DLm are connected to the data driving circuit 200. A person of ordinary skill in the art should understand and appreciate that only some of the plurality of gate lines GL1 to GLn+4 and only some of the plurality of data lines DL1 to DLm are illustrated in FIG. 1.

In addition, only some of the plurality of pixels PX11 to PXnm are illustrated in FIG. 1. The plurality of pixels PX11 to PXnm are respectively connected to a corresponding first gate line and second gate line among the plurality of gate lines GL1 to GLn+4 and corresponding data lines from among the plurality of data lines DL1 to DLm.

The plurality of pixels PX11 to PXnm may be divided into a plurality of groups according to a color displayed. The plurality of pixels PX11 to PXnm may display one of the primary colors. The colors displayed may include red, green, blue, and white. However, the embodiment of the inventive concept is not limited thereto and thus the display of primary colors may further include various colors such as yellow, cyan, magenta, and so on.

The gate driving circuit 100 and the data driving circuit 200 receive a control signal from the driving controller 300. The driving controller 300 may be mounted on a main circuit board MCB. The driving controller (not shown). The control signals may include vertical sync signals (Vsync) that are signals for distinguishing frame sections Ft and Ft+1, horizontal sync signals Hsync that are signals for distinguishing horizontal periods (HP), e.g., row distinction signals, and data enable signals (that are in high level only during a period where data is outputted to display a data incoming area), and clock signals.

The gate driving circuit 100 generates gate signals G1 to Gn+4 (see FIG. 2) in accordance with receipt of a control signal (hereinafter referred to as a "gate control signal") received from the driving controller 300 through a gate signal line GSL and outputs the gate signals G1 to Gn+4 to the plurality of gate lines GL1 to GLn+4, respectively, during the frame sections Ft and Ft+1. The gate signals G1 to Gn+4 may be sequentially outputted in correspondence to the horizontal periods H. The gate driving circuit 100 and the pixels PX11 to PXnm may be formed simultaneously through a thin-film process. For example, the gate driving circuit 100 may be mounted as an Oxide Semiconductor TFT Gate driver circuit (OSG) in the non-display area NDA.

FIG. 1 illustrates a single gate driving circuit 100 connected to the left ends of each of the plurality of gate lines GL1 to GLn+4 that are shown. However, according to an embodiment of the inventive concept, a display device may include, for example, two gate driving circuits. For example, one of the two gate driving circuits may be connected to the left ends of the plurality of gate lines GL1 to GLn+4 (e.g. shown in FIG. 1) and the other gate driving circuit may be connected, for example, to the right ends of the plurality of gate lines GL1 to GLn+4. Additionally, if two gate driving circuits are present, one of the two gate driving circuits may be connected to odd-numbered gate lines and the other gate driving circuit may be connected to even-numbered gate lines.

The data driving circuit 200 may generate grayscale voltages according to image data provided from the driving controller 300 on the basis of a control signal (hereinafter referred to as a "data control signal") received from the driving controller 300. The data driving circuit 200 outputs the generated grayscale voltages as data voltages DS to the plurality of data lines DL1 to DLm.

Data voltages provided to the data lines DL1 to DLm may include positive data voltages having a positive value and/or negative data voltages having a negative value, with respect to a common voltage. Some of the data voltages applied to the data lines DL1 to DLm have a positive polarity and others have a negative polarity during each of the horizontal periods H. The polarity of the data voltages may be inverted according to the frame sections Ft and Ft+1 and may prevent the deterioration of a liquid crystal. The data driving circuit 200 may generate data voltages inverted by each frame section in response to receiving a data control signal that inverts the polarity of the data voltages.

The data driving circuit 200 may include a driving chip (semiconductor) 210 and a flexible circuit board 220 upon which the driving chip 210 may be mounted. The data driving circuit 200 may include a plurality of driving chips 210 and the flexible circuit board 220. The flexible circuit board 220 electrically connects the main circuit board (MCB) and the first substrate DS1. The plurality of driving chips 210 provide data signals corresponding to data lines from among the plurality of data lines DL1 to DLm.

FIG. 1 illustrates an example of a Tape Carrier Package (TCP) type data driving circuit 200. According to another embodiment of the inventive concept, the data driving circuit 200 may be disposed on the non-display area NDA of the first substrate DS1 through a Chip on Glass (COG) method.

Figure 3:
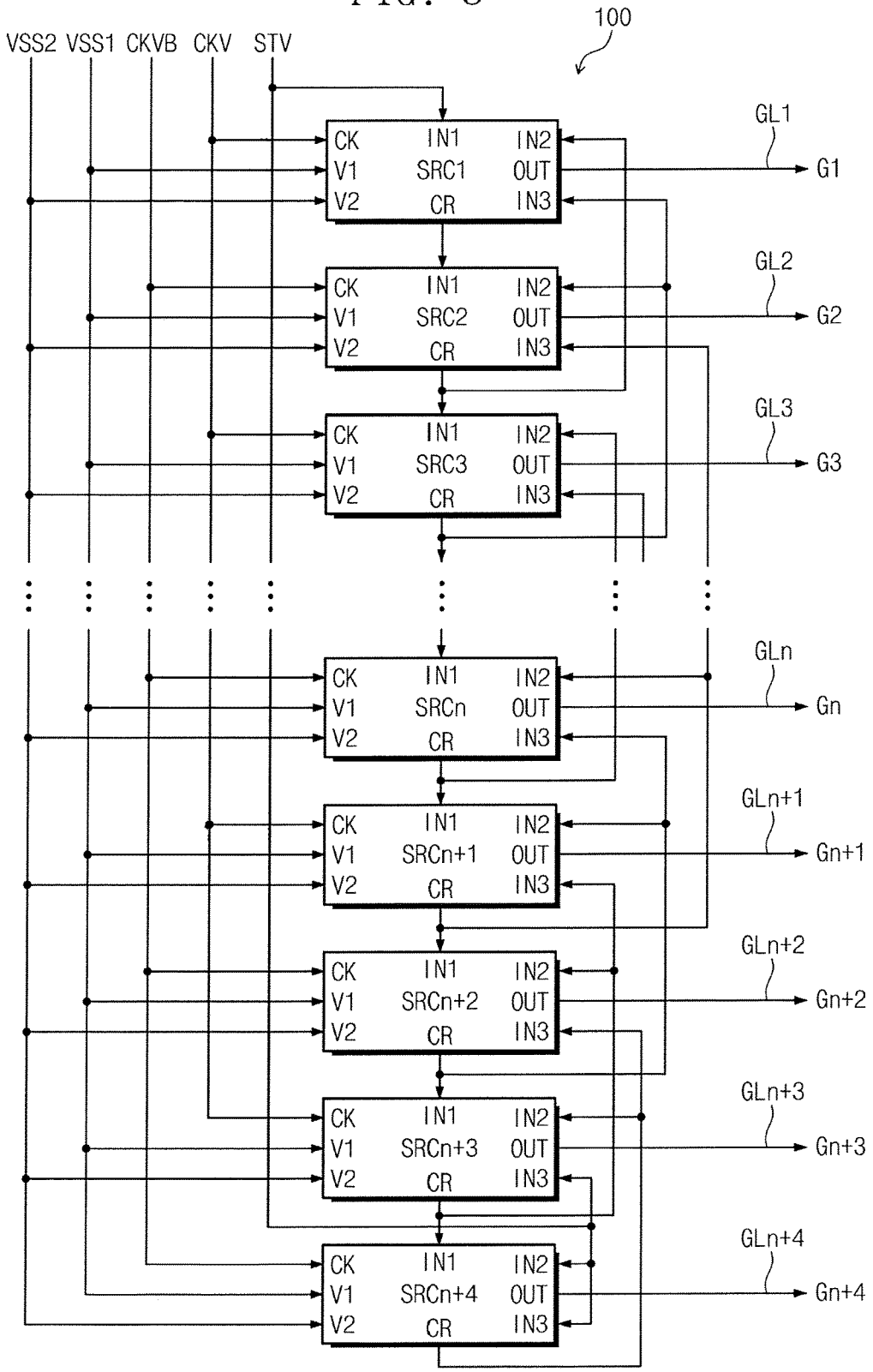
FIG. 3 is a block diagram of a gate driving circuit according to an embodiment of the inventive concept.

FIG. 3 is a block diagram illustrating a gate driving circuit according to an embodiment of the inventive concept.

As shown in FIG. 3, a gate driving circuit 100 may include a plurality of driving stages SRC1 to SRCn and "dummy" driving stages SRCn+1, SRCn+2, SRCn+3, and SRCn+4. The plurality of driving stages SRC1 to SRCn and dummy driving stages SRCn+1, SRCn+2, SRCn+3, and SRCn+4 have a cascaded relationship (e.g. a cascaded arrangement) in which they operate in response to a received carry signal outputted from a previous stage and a carry signal outputted from the next stage. Each of the plurality of driving stages SRC1 to SRCn and dummy driving stages SRCn+1, SRCn+2, SRCn+3, and SRCn+4 receives a first clock signal (CKV), a second clock signal (CKVB), a first ground voltage (VSS1), and a second ground voltage (VSS2) from the driving controller 300 shown in FIG. 1. The driving stage SRC1 and the dummy driving stages SRCn+1 and SRCn+2 further receive a start signal STV.

According to the embodiment of the inventive concept shown in FIG. 3, the plurality of driving stages SRC1 to SRCn are respectively connected to the plurality of gate lines GL1 to GLn, and the dummy driving stages SRCn+1, SRCn+2, SRCn+3, and SRCn+4 are respectively connected to dummy gate lines GLn+1, GLn+2, GLn+3, and GLn+4. The plurality of driving stages SRC1 to SRCn and the dummy driving stages SRCn+1, SRCn+2, SRCn+3, and SRCn+4 provide gate signals to the plurality of gate lines GL1 to GLn, respectively.

Each of the plurality of driving stages SRC1 to SRCn and dummy driving stages SRCn+1, SRCn+2, SRCn+3, and SRCn+4 include input terminals IN1, IN2, and IN3, an output terminal (OUT), a carry terminal (CR), a control terminal (CT, not shown), a clock terminal (CK), a first ground terminal (V1), and a second ground terminal (V2).

The output terminal OUT of each of the plurality of driving stages SRC1 to SRCn and dummy driving stages SRCn+1, SRCn+2, SRCn+3, and SRCn+4 is connected to a corresponding gate line among the plurality of gate lines GL1 to GLn+4. The gate signals G1 to Gn+4 generated by the plurality of driving stages SRC1 to SRCn and dummy driving stages SRCn+1, SRCn+2, SRCn+3, and SRCn+4 are provided to the plurality of gate lines GL1 to GLn+4 through the output terminal OUT.

The carry terminal CR of each of the plurality of driving stages SRC1 to SRCn and dummy driving stages SRCn+1, SRCn+2, SRCn+3, and SRCn+4 is electrically connected to the first input terminal IN1 of the next driving stage of a corresponding driving stage that are in a cascaded arrangement. Additionally, the carry terminal CR of each of the plurality of driving stages SRC1 to SRCn and dummy driving stages SRCn+1, SRCn+2, SRCn+3, and SRCn+4 is connected to previous driving stages. For example, the carry terminal CR of the k-th driving stage among the driving stages SRC1 to SRCn is connected to the second input terminal IN2 of the (k−1)th driving stage SRCk−1 hand the third input terminal IN3 of the (k−2)th driving stage SRCk−1. The carry terminal CR of each of the plurality of driving stages SRC1 to SRCn and the dummy driving stages SRCn+1, SRCn+2, SRCn+3, and SRCn+4 outputs a carry signal.

The input terminal IN1 of each of the plurality of driving stages SRC2 to SRCn and the dummy driving stages SRCn+1, SRCn+2, SRCn+3, and SRCn+4 receives a carry signal of a previous driving stage of a corresponding driving stage that are in the cascaded arrangement. For example, the first input terminal IN1 of the k-th driving stage SRCk receives the carry signal of the (k−1)th driving stage SRCk−1. The first input terminal IN1 of the first driving stage SRC1 among the plurality of driving stages SRC1 to SRCn receives a vertical start signal STV to start the driving of the gate driving circuit 100 instead of receiving a carry signal of a previous driving stage.

With continued reference to FIG. 3, the second input terminal IN2 of each of the plurality of driving stages SRC1 to SRCn and the dummy driving stages SRCn+1, SRCn+2, SRCn+3, and SRCn+4 receives a carry signal from the carry terminal CR of the next driving stage of a corresponding driving stage. The third input terminal IN3 of each of the plurality of driving stages SRC1 to SRCn and dummy driving stages SRCn+1 and SRCn+2 receives a carry signal of a second next driving stage of a corresponding driving stage. For example, the second input terminal IN2 of the k-th driving stage SRCk receives a carry signal outputted from the carry terminal CR of the (k+1)th driving stage SRCk+1. The third input terminal IN3 of the k-th driving stage SRCk receives a carry signal outputted from the carry terminal CR of the k+2th driving stage SRCk+2. According to another embodiment of the inventive concept, the second input terminal IN2 of each of the plurality of driving stages SRC1 to SRCn may be electrically connected to the output terminal OUT of the next driving stage of a corresponding driving stage. Additionally, the third input terminal IN3 of each of the plurality of driving stages SRC1 to SRCn may be electrically connected to the output terminal OUT of second next driving stage of a corresponding driving stage.

The second input terminal IN2 and the third input terminal IN3 of the dummy driving stage SRCn+4 and the third input terminal IN3 of the dummy driving stage SRCn+3, which are disposed at the ends, receive a vertical start signal STV.

The clock terminal CK of each of the plurality of driving stages SRC1 to SRCn may receive one of the first clock signal CKV and the second clock signal CKVB. Each of the clock terminals CK of the odd driving stages SRC1, SRC3, SRCn−1 from among the plurality of driving stages SRC1 to SRCn may receive the first clock signal CKV. Each of the clock terminals CK of the even driving stages SRC2, SRC4, . . . , SRCn among the plurality of driving stages SRC1 to SRCn may receive the second clock signal CKVB. The first clock signal CKV and the second clock signal CKVB may have different phases.

The first ground terminal V1 of each of the plurality of driving stages SRC1 to SRCn and dummy driving stages SRCn+1, SRCn+2, and SRCn+3, SRCn+4 receives a first ground voltage VSS1. The second ground terminal V2 of each of the plurality of driving stages SRC1 to SRCn and dummy driving stages SRCn+1, SRCn+2, and SRCn+3, SRCn+4 receives a second ground voltage VSS2. The first ground voltage VSS1 and the second ground voltage VSS2 have different voltage levels and the second ground voltage VSS2 has a lower voltage level than the first ground voltage VSS1.

According to an embodiment of the inventive concept, according to a circuit structure, each of the plurality of driving stages SRC1 to SRCn and dummy driving stages SRCn+1, SRCn+2, and SRCn+3, SRCn+4 may omit one of the output terminal OUT, the first input terminal IN1, the second input terminal IN2, the third input terminal IN3, the carry terminal CR, the control terminal CT, the clock terminal CK, the first ground terminal V1, and the second ground terminal V2 or may further include other terminals. Additionally, the interconnection relationship of the plurality of driving stages SRC1 to SRCn and dummy driving stages SRCn+1, SRCn+2, SRCn+3, and SRCn+4 may also be changed.

Figure 4:
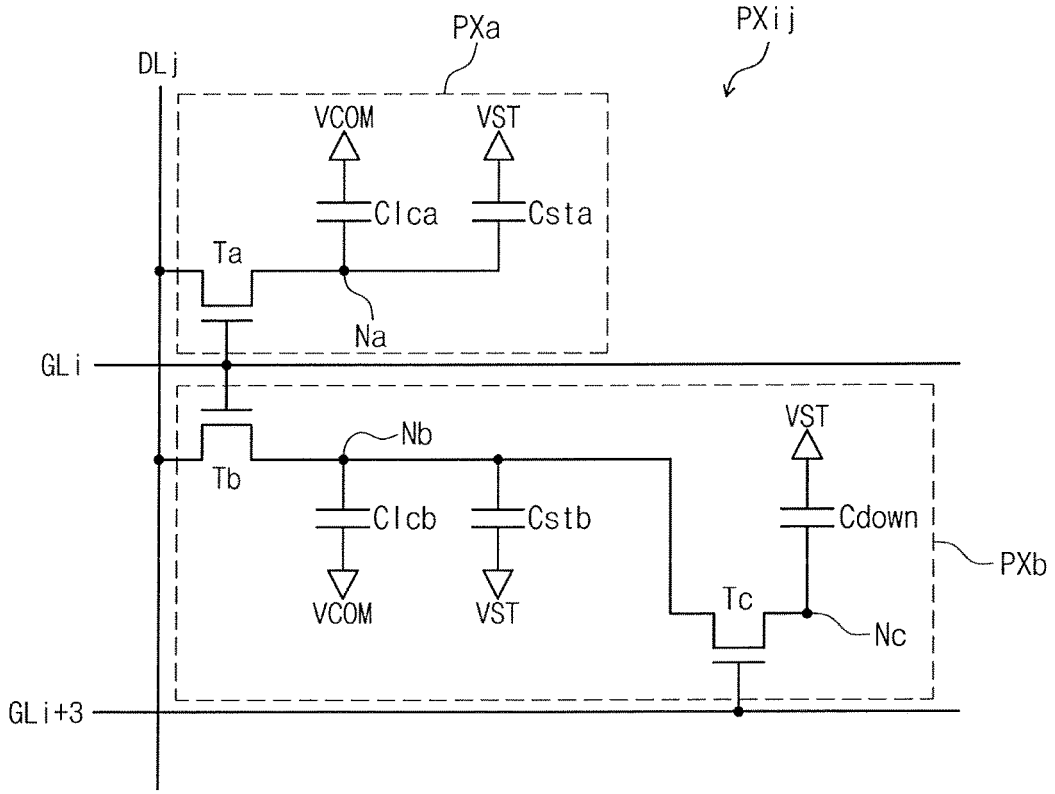
FIG. 4 is an equivalent circuit diagram of a pixel according to an embodiment of the inventive concept.

FIG. 4 is an equivalent circuit diagram of a pixel according to an embodiment of the inventive concept. A pixel PXij shown in FIG. 4 has two sub-pixels (P×a and P×b), and is connected to a first gate line GLi (i.e., the i-th gate line), a second gate line GLi+3 (i.e., the (i+3)th data line), and a jth data line DLj. The pixel PXij includes one pair of a first sub-pixel PXa and a second sub-pixel PXb. The first sub-pixel PXa and the second sub-pixel PXb face each other with the first gate line GLi arranged therebetween. The first sub-pixel PXa and the second sub-pixel PXb are commonly connected to the first gate line GLi and the data line DLj (where i and j are positive integers). Additionally, the sub-pixels PXa and PXb may have different sizes, as the sub-pixels may have different components. For example, FIG. 4 shows that the first sub-pixel PXa disposed above the second sub-pixel PXb with the gate line GLi therebetween may have a smaller size than the second sub-pixel PXb disposed below the gate line GLi.

The positions of the first and second sub-pixels PXa and PXb in adjacent pixels among the plurality of pixels PX11 to PXnm shown in FIG. 1 may be alternately arranged. For example, the positions of the first and second sub-pixels PXa and PXb may be alternately arranged in a plurality of pixels arranged in a horizontal direction of the display panel DP, for example, an extension direction of the gate lines GL1 to GLn+4. Additionally, the positions of the first and second sub-pixels PXa and PXb may be alternately arranged in a plurality of pixels in a vertical direction of the display panel DP, for example, an extended direction of the data lines DL1 to DLm. With such an arrangement, it is possible to reduce the visibility degradation resulting from the difference in the layout of the first and second sub-pixels PXa and PXb.

With continued reference to FIG. 4, the first sub-pixel PXa receives a data signal Dj through a corresponding data line DLj from among the plurality of data lines DL1 to DLm in response to a first gate signal Gi received through a first gate line GLi from among the gate lines GL1 to GLn+4 shown in FIG. 1.

The second sub-pixel PXb receives the data signal Dj through a corresponding data line DLj among the plurality of data lines DL1 to DLm in response to the first gate signal Gi received through the first gate line GLi among the gate lines GL1 to GLn+4 shown in FIG. 2 and lowers (e.g. reduces) the potential (e.g. voltage) of the received data signal Dj in response to a second gate signal Gi+3 received through a second gate line GLi+3.

The first sub-pixel PXa includes a first switching transistor Ta, a first liquid crystal capacitor Clca, and a first storage capacitor Csta. Hereinafter, a switching transistor for this embodiment may refer to a thin film transistor. According to an embodiment of the inventive concept, the first sub-pixel PXa can function even if the first storage capacitor Csta is omitted.

The first switching transistor Ta includes a first electrode connected to the jth data line DLj, a second electrode connected to a first node Na, and a gate electrode connected to the first gate line GLi, e.g. the i-th gate line. The first switching transistor Ta may output a data voltage corresponding to the data signal Dj received from the jth data line DLj in response to the first gate signal Gi being received from the first gate line GLi.

The first liquid crystal capacitor Clca of the first sub-pixel PXa is connected between the first node Na and a common electrode for receiving a common voltage VCOM. The first storage capacitor Csta is connected between the first node Na and a storage electrode for receiving a storage voltage VST. The first liquid crystal capacitor Clca is charged with a data voltage of the first node Na outputted from the first switching transistor Ta. The arrangement of liquid crystal directors included in a liquid crystal layer (not shown) of the first liquid crystal capacitor Clca changes according to a charge amount charged in the first liquid crystal capacitor Clca. The light incident to a liquid crystal layer may be transmitted or blocked according to the arrangement of liquid crystal directors. The first storage capacitor Csta is connected in parallel to the first liquid crystal capacitor Clca. The first storage capacitor Csta may provide an output of charge that maintains the arrangement of the liquid crystal directors during a predetermined period.

The second sub-pixel PXb includes a second switching transistor Tb, a second liquid crystal capacitor Clcb, a second storage capacitor Cstb, a third switching transistor Tc, and a pull-down capacitor Cdown. According to an embodiment of the inventive concept, the second sub-pixel (PXb) may function in a configuration where the second storage capacitor Cstb is omitted.

With continued reference to FIG. 4, the second switching transistor Tb includes a first electrode connected to the jth data line DLj, a second electrode connected to a second node Nb, and a gate electrode connected to the first gate line GLi that is the i-th gate line. The second switching transistor Tb outputs a data voltage corresponding to the data signal Dj received from the jth data line DLj in response to the first gate signal Gi received from the first gate line GLi.

The second liquid crystal capacitor Clcb may be connected, for example, between the second node Nb and a common electrode for receiving a common voltage VCOM. The second storage capacitor Cstb may be connected, for example, between the second node Nb and a storage electrode for receiving a storage voltage VST. The second liquid crystal capacitor Clcb is charged with a data voltage of the second node Nb outputted from the second switching transistor Tb. The arrangement of liquid crystal directors included in a liquid crystal layer (not shown) of the second liquid crystal capacitor Clcb changes according to a charge amount charged in the second liquid crystal capacitor Clcb. The light incident to a liquid crystal layer may be transmitted or blocked according to the arrangement of liquid crystal directors. The second storage capacitor Cstb is connected in parallel to the second liquid crystal capacitor Clcb. The second storage capacitor Cstb maintains the arrangement of liquid crystal directors during a predetermined period.

The third switching transistor Tc may include, for example, a first electrode connected to the second node Nb, a second electrode connected to a third node Nc, and a gate electrode connected to the second gate line GLi+3 that is the (i+3)th gate line. The third switching transistor Tc outputs a data voltage of the second node Nb to the third node Nc in response to the second gate signal Gi+3 received from the second gate line GLi+3. The pull-down capacitor Cdown is connected between the third node Nc and a storage electrode for receiving a storage voltage VST. When the third switching transistor Tc is turned on, a data voltage of the second node Nb is delivered to the pull-down capacitor Cdown through the third switching transistor Tc, so that the potential of a data voltage of the second node Nb of the second switching transistor may be lowered (e.g. reduced).

Figure 5:
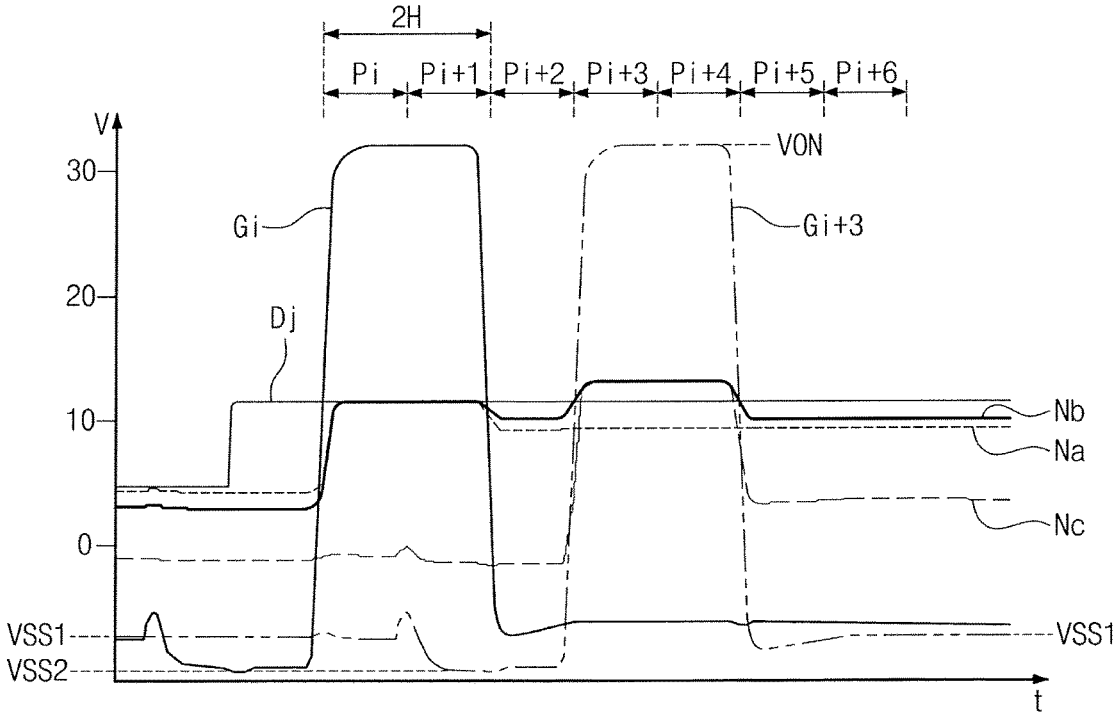
FIG. 5 is a timing diagram illustrating an operation of the pixel shown in FIG. 4.

FIG. 5 is a timing diagram illustrating an operation of a pixel shown in FIG. 4.

Referring to FIGS. 4 and 5, when the data signal Dj is provided to the jth data line Dj and the i-th gate signal Gi is activated as a high level, since the data signal Dj is delivered to each of the first node Na and the second node Nb, the voltages of the first node Na and the second node Nb rise to a voltage level of the data signal Dj.

When the i-th gate signal Gi shifts from a high level to a low level, each of the first switching transistor Ta and the second switching transistor Tb is turned off. As the first switching transistor Ta and the second switching transistor Tb are turned on, a data voltage applied to the first liquid crystal capacitor Clca, the first storage capacitor Csta, the second liquid crystal capacitor Clcb, and the second storage capacitor Cstb may be maintained for a predetermined period of time after the first switching transistor Ta and the second switching transistor Tb are turned off.

However, due to a parasitic capacitance between the gate electrode of the first switching transistor Ta and the first node Na and a parasitic capacitance between the gate electrode of the second switching transistor Tb and the second node Nb, distortion may occur in a data voltage applied to the first liquid crystal capacitor Clca, the first storage capacitor Csta, the second liquid crystal capacitor Clcb, and the second storage capacitor Cstb. This voltage distortion is called the kickback voltage. For example, when each of the first switching transistor Ta and the second switching transistor Tb is turned off, the voltages of the first node Na and the second node Nb are lowered (e.g. reduced) by the kickback voltage.

A voltage of the second node Nb may be reduced by the third switching transistor Tc and the pull-down capacitor Cdown. After the i-th gate signal Gi shifts from a relatively high level to a relatively low level (such as shown in FIG. 5), reduced voltage may be realized by turning on the third switching transistor Tc. In the case that the (i+3)th gate signal Gi+3 is applied to the gate electrode of the third switching transistor Tc, when the (i+3)th gate signal Gi+3 shifts from a lower level to a higher level, the third switching transistor Tc is turned on. When the third switching transistor Tc is turned on, the data voltage applied to the second liquid crystal capacitor Clcb and the second storage capacitor Cstb is provided to the pull-down capacitor Cdown. Moreover, when the (i+3)th gate signal Gi+3 in a high level is provided to the gate electrode of the third switching transistor Tc, by a coupling capacitance between the gate electrode of the third switching transistor Tc and the second node Nb and a coupling capacitance between the gate electrode of the third switching transistor Tc and the third node Nc, the voltages of the second node NB and the third node NC rise higher than the data voltage. When the (i+3)th gate signal Gi+3 shifts from a high level to a low level, the voltages of the second node NB and the third node NC are lowered.

With reference to FIG. 3, the clock terminal CK of each of the plurality of driving stages SRC1 to SRCn receives one of the first clock signal CKV and the second clock signal CKVB. The first clock signal CKV and the second clock signal CKVB are signals swinging between the gate on voltage VON and the second ground voltage VSS2.

The waveform changes of the gate signals G1 to Gn+4 are described as one example of the (i+3)th gate signal Gi+3. The (i+3)th gate signal Gi+3 is maintained as the first ground voltage VSS1 until an i-th horizontal period Pi and is discharged as the second ground voltage VSS2 of the first clock signal CKV or the second clock signal CKBV in the i+1 th horizontal period Pi+1. The (i+3)th gate signal Gi+3 rises to the gate on voltage VON of the first clock signal CKV or the second clock signal CKBV in the (i+3)th horizontal period Pi+3. The pulse width of each of the i-th gate signal Gi and the (i+3)th gate signal Gi+3 is 2×H. In the i+5th horizontal period Pi+5, the (i+3)th gate signal Gi+3 is discharged as the first ground voltage VSS1.

The (i+3)th gate signal Gi+3 rises from the second ground voltage VSS2 to the gate on voltage VON in the (i+3)th horizontal period Pi+3 and is discharged as the first ground voltage VSS1 in the i+5th horizontal period Pi+5. For example, the (i+3)th gate signal Gi+3 has a voltage level changed in the order of the second ground voltage VSS2, the gate on voltage VON, and the first ground voltage VSS1. A coupling capacitance between the (i+3)th gate signal GLi+3 and the second node Nb when the (i+3)th gate signal Gi+3 changes from the second ground voltage VSS2 to the gate on voltage VON and a coupling capacitance between the (i+3) th gate line GLi+3 and the second node Nb when the (i+3)th gate signal Gi+3 changes from the gate on voltage VON to the first ground voltage VSS1 may have different values.

Therefore, after the (i+3)th gate signal Gi+3 is discharged as the first ground voltage VSS1, a voltage level of the second node Nb in the second sub-pixel PXb may not be sufficiently lower than a voltage level of the first node Na of the first sub-pixel PXa.

Figure 6:
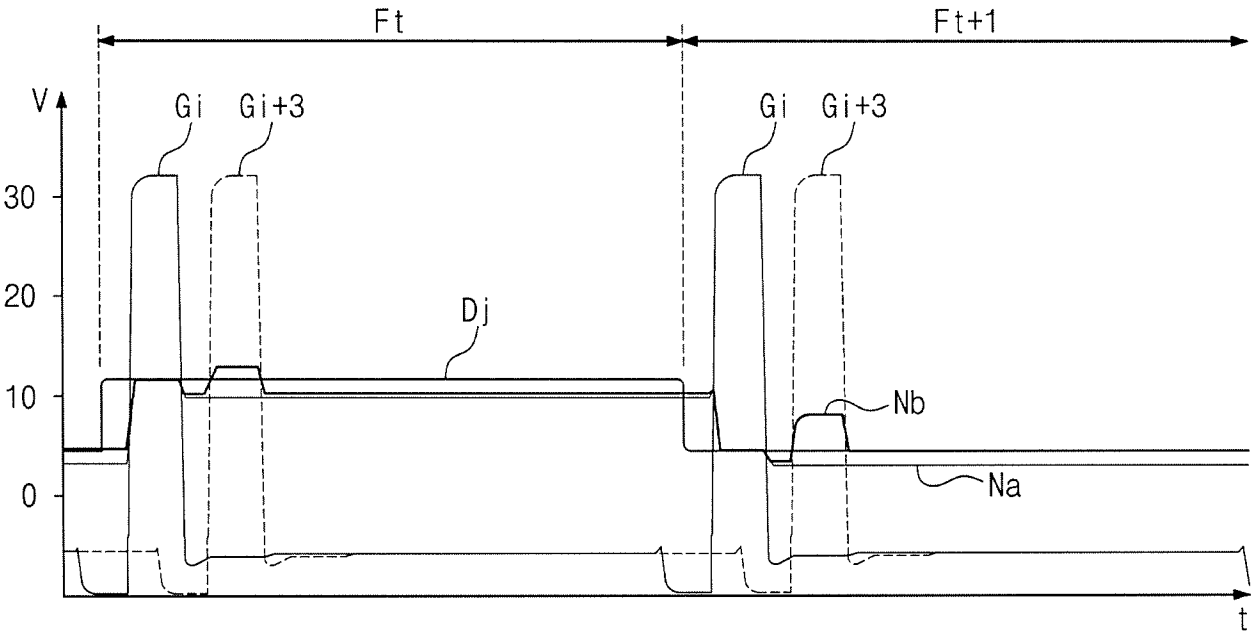
FIG. 6 is a timing diagram illustrating a polarity inversion operation of the pixel shown in FIG. 4.

FIG. 6 is a timing diagram illustrating one example of a polarity inversion operation of a pixel shown in FIG. 4.

Referring to FIGS. 4 and 6, the data signal Dj provided to the data line DLj is a positive data voltage during the first frame section Ft and is a negative data voltage during the second frame section Ft+2.

Due to a coupling capacitance between the (i+3)th gate line GLi+3 and the second node Nb in the second sub-pixel PXb, a voltage of the second node Nb may not be sufficiently lower than a voltage of the first node Na in the first sub-pixel PXa during the first frame section Ft where a positive data signal is provided to the data line DLj. In this case, even when a positive data signal and a negative data signal corresponding to the same grayscale are provided to the data line DLj in the first frame section Ft and the second frame section Ft+1, based on the common voltage VCOM, a voltage level of the second node Nb varies in the first frame section Ft and the second frame section Ft+1, that may cause flicker to occur.

Figure 7:
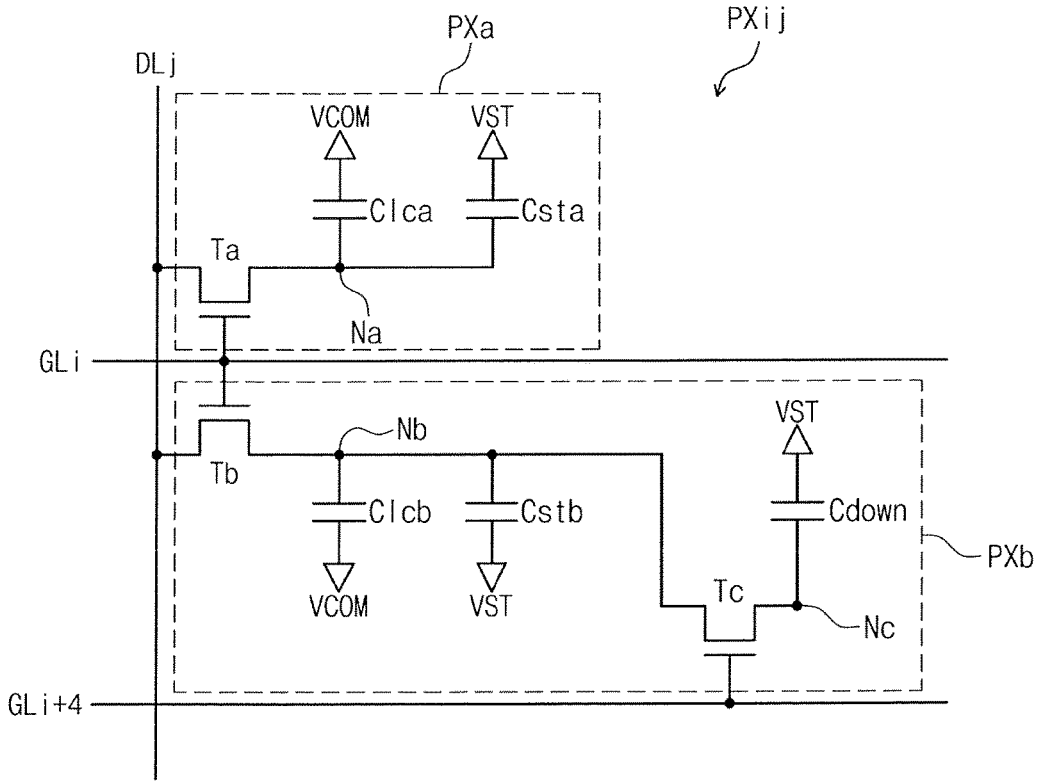
FIG. 7 is an equivalent circuit diagram of a pixel according to an embodiment of the inventive concept.

FIG. 7 is an equivalent circuit diagram of a pixel according to an embodiment of the inventive concept. A pixel PXij shown in FIG. 7 is connected a first gate line GLi that is the i-th gate line, a second gate line GLi+4 that is the (i+4)th gate line, and a jth data line DLj. The pixel PXij includes one pair of a first sub-pixel PXa and a second sub-pixel PXb. The first sub-pixel PXa and the second sub-pixel PXb face each other with the first gate line GLi therebetween. The first sub-pixel PXa and the second sub-pixel PXb are commonly connected to the first gate line GLi and the data line DLj (where i and j are positive integers).

Since the pixel PXij shown in FIG. 7 has a similar configuration to the pixel PXij shown in FIG. 4, overlapping descriptions are omitted.

The first sub-pixel PXa receives a data signal Dj through a corresponding data line DLj from among the plurality of data lines DL1 to DLm in response to a first gate signal Gi received through a first gate line GLi among the gate lines GL1 to GLn+4 shown in FIG. 1.

The second sub-pixel PXb receives the data signal Dj through a corresponding data line DLj among the plurality of data lines DL1 to DLm in response to the first gate signal Gi received through the first gate line GLi among the gate lines GL1 to GLn+4 shown in FIG. 1 and lowers (e.g. reduces) the voltage of the received data signal Dj in response to a second gate signal Gi+4 received through a second gate line GLi+4.

Herein, when the pulse width of the first gate signal Gi is d×H (where each of d and H is a positive integer and H is a horizontal period), a gate signal delayed by the 2×d×H time relative to the first gate signal Gi may be provided to the second sub-pixel PXb. For example, when the pulse width of the first gate signal Gi is 2×H and the i-th gate signal Gi is provided as the first gate signal to the first and second sub-pixels PXa and PXb, the second gate signal provided to the second sub-pixel PXb may be the (i+4)th gate signal Gi+4.

As another example, when the pulse width of the first gate signal Gi is 4×H and the i-th gate signal Gi is provided as the first gate signal to the first and second sub-pixels PXa and PXb, the second gate signal provided to the second sub-pixel PXb may be the (i+8)th gate signal Gi+8. In this case, the gate line connected to the third switching transistor Tc is the (i+8)th gate line GLi+8.

Figure 8:
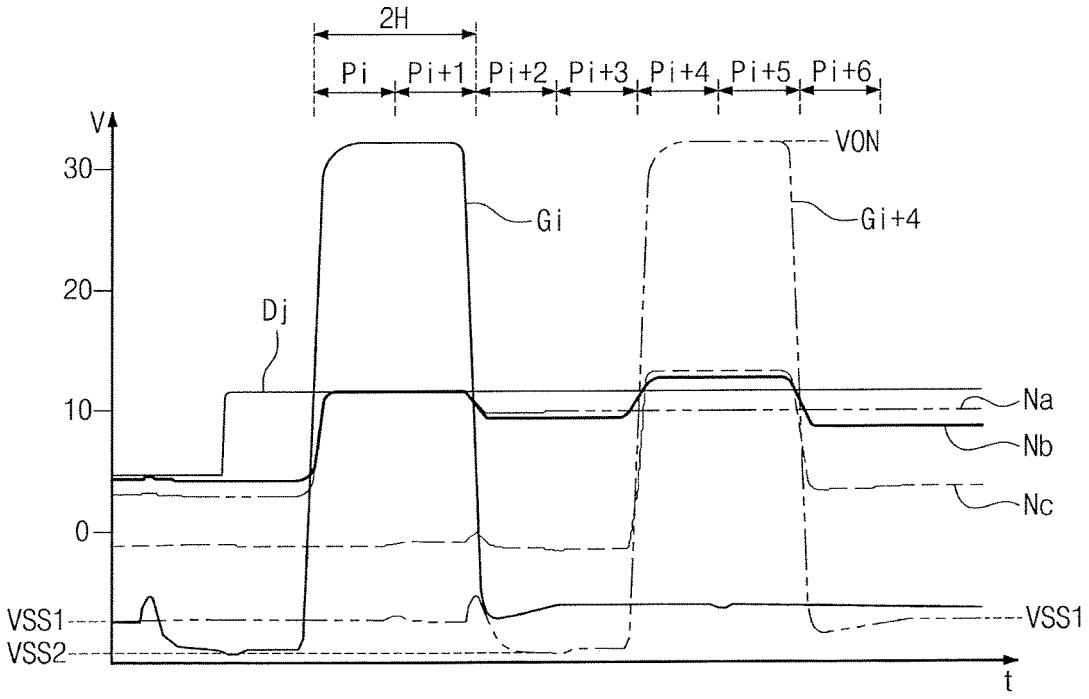
FIG. 8 is a timing diagram illustrating an operation of the pixel shown in FIG. 7.

FIG. 8 is a timing diagram illustrating an operation of a pixel shown in FIG. 7.

Referring to FIGS. 7 and 8, when the data signal Dj is provided to the jth data line Dj, and the i-th gate signal Gi is activated at a high level in the i-th horizontal period Pi, since the data signal Dj is delivered to each of the first node Na and the second node Nb, the voltages of the first node Na and the second node Nb rise to a voltage level of the data signal Dj.

When the i-th gate signal Gi shifts from a high level to a low level in the i+2th horizontal period Pi+2, each of the first switching transistor Ta and the second switching transistor Tb is turned off. When the first switching transistor Ta and the second switching transistor Tb are turned off, the voltages of the first node Na and the second node Nb are lowered by the kickback voltage. Additionally, in the i+2th horizontal period Pi+2, the (i+4)th gate signal Gi+4 is discharged from the first ground voltage VSS1 as the second ground voltage VSS2. By a coupling capacitance between the second gate line GLi+4 and the second node Nb, the voltage of the second node Nb in the second sub-pixel PXb becomes lower than the voltage of the first node Na in the first sub-pixel PXa.

When the (i+4)th gate signal Gi+4 shifts from a low level to a high level in the (i+4)th horizontal period Pi+4, the third switching transistor Tc is turned on. When the third switching transistor Tc is turned on, the data voltage applied to the second liquid crystal capacitor Clcb and the second storage capacitor Cstb is provided to the pull-down capacitor Cdown. Moreover, when the (i+4)th gate signal Gi+4 in a high level is provided to the gate electrode of the third switching transistor Tc, by a coupling capacitance between the gate electrode of the third switching transistor Tc and the second node Nb and a coupling capacitance between the gate electrode of the third switching transistor Tc and the third node Nc, the voltages of the second node Nb and the third node Nc rise higher than the data voltage.

When the (i+4)th gate signal Gi+4 shifts from a high level to a low level in the (i+6)th horizontal period Pi+6, the voltages of the second node Nb and the third node Nc are lowered.

When FIGS. 5 and 8 are compared, as the (i+4)th gate signal Gi+4 is discharged from the first ground voltage VSS I as the second ground voltage VSS2 in the i+2th horizontal period Pi+2, by a coupling capacitance between the (i+4)th gate line GLi+4 and the second node Nb, the voltage of the second node Nb shown in FIG. 8 is lower than the voltage of the second node Nb shown in FIG. 5.

As the (i+4)th gate signal Gi+4 shifts to a high level in the (i+4)th horizontal period Pi+4 shown in FIG. 8, even if the voltage of the second node Nb rises, the voltage of the second Nb shown in FIG. 8 is lower than the potential of the second node Nb in the (i+3)th horizontal period Pi+3.

As the (i+4)th gate signal Gi+4 shifts to a low level in the (i+6)th horizontal period Pi+6 shown in FIG. 8, when the voltage of the second node Nb drops, the voltage of the second Nb shown in FIG. 8 is lower than the voltage of the second node Nb in the i+5th horizontal period Pi+5. Especially, after the (i+6)th horizontal period Pi+6, the voltage of the second node Nb is sufficiently lower than the voltage of the first node Na, which may result in the visibility of the pixel PXij being increased.

Figures 9, 10:
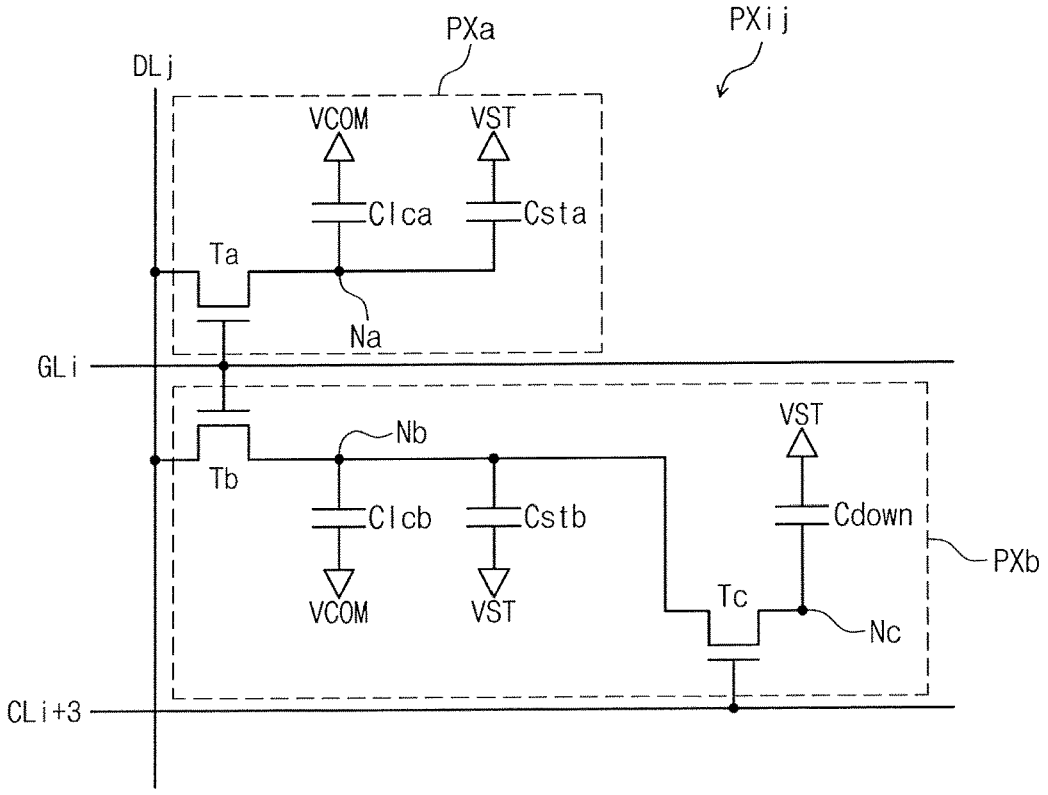
FIG. 9 is a view illustrating voltage changes of a first node and a second node according to a gate line connected to a third switching transistor of a second sub-pixel.
FIG. 10 is an equivalent circuit diagram of a pixel according to another embodiment of the inventive concept.

FIG. 9 is a view illustrating voltage changes of a first node and a second node according to a gate line connected to a third switching transistor of a second sub-pixel.

Referring to FIGS. 4, 7, and 9, in each of the i+2th horizontal period Pi+2 and the (i+4)th horizontal period Pi+4, a voltage of the second node Nb when a gate line connected to the gate electrode of the third switching transistor Tc is the (i+4)th gate line GLi+4 is lower than a voltage of the second node Nb when a gate line connected to the gate electrode of the third switching transistor Tc is the (i+3)th gate line GLi+3.

Therefore, in the (i+6)th horizontal period Pi+6, a voltage of the second node Nb when a gate line connected to the gate electrode of the third switching transistor Tc is the (i+4)th gate line GLi+4 may be lower than a voltage of the second node Nb when a gate line connected to the gate electrode of the third switching transistor Tc is the (i+3)th gate line GLi+3. Therefore, the voltage of the second node Nb is sufficiently lower than the potential of the first node Na so that the visibility of the pixel PXij may be increased.

FIG. 10 is an equivalent circuit diagram of a pixel according to another embodiment of the inventive concept.

A pixel PXij shown in FIG. 10 is connected a first gate line GLi (i.e., the i-th gate line), an (i+3)th carry line CLi+3, and a jth data line DLj. Since the pixel PXij shown in FIG. 10 has a similar configuration to the pixel PXij shown in FIG. 4, overlapping descriptions are omitted.

The pixel PXij includes a sub-pixel pair including a first sub-pixel PXa and a second sub-pixel PXb. The first sub-pixel PXa receives a data signal Dj through a corresponding data line DLj among the plurality of data lines DL1 to DLm in response to a first gate signal Gi received through a first gate line GLi among the gate lines GL1 to GLn shown in FIG. 1.

The second sub-pixel PXb receives the data signal Dj through a corresponding data line DLj among the plurality of data lines DL1 to DLm in response to the first gate signal Gi received through the first gate line GLi among the gate lines GL1 to GLn (shown in FIG. 1) and lowers the voltage of the received data signal Dj in response to a first carry signal GLi+3 received through a first carry line CLi+3.

Herein, when the pulse width of the first gate signal Gi is d×H (where each of d and H is a positive integer and H is a horizontal period), a carry signal delayed by the d×H+1 time than the first gate signal Gi may be provided as the first carry signal Ci+3 to the second sub-pixel PXb.

When each of the pixels PX11 to PXnm of the display panel DP shown in FIG. 1 includes the pixel PXij shown in FIG. 10, the display panel DP may include only the gate lines GL1 to GLn except for a dummy gate line. The first carry line CLi+3 extends from the carry terminal CR of each of the stages SRC1 to SRCn and the dummy driving stages SRCn+1, SRCn+2, and SRCn+3 shown in FIG. 3 to be arranged parallel to the gate lines GL1 to GLn of the display panel DP.

Figure 11:
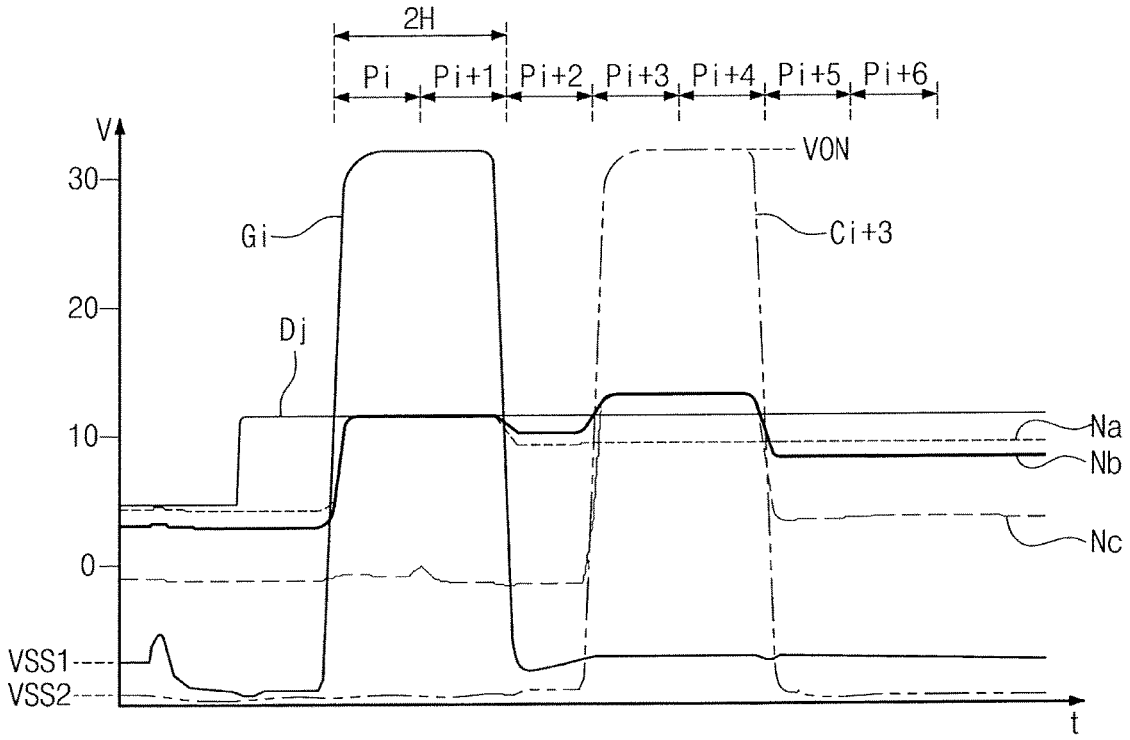
FIG. 11 is a timing diagram illustrating an operation of the pixel shown in FIG. 10.

FIG. 11 is a timing diagram illustrating an operation of a pixel shown in FIG. 10.

Referring to FIGS. 10 and 11, after discharged from the first ground voltage VSS1 as the second ground voltage VSS2, the first gate signal Gi rises to the gate on voltage VON. In the (i+3)th horizontal period Pi+3, the first carry signal Ci rises from the second ground voltage VSS2 to the gate on voltage VON. In the i+5th horizontal period Pi+5, the first carry signal Ci is discharged from the gate on voltage VON as the second ground voltage VSS2. Since a voltage level before and after the first carry signal Ci rises to the gate on voltage VON is identical to that of the second ground voltage VSS2, a coupling capacitance of the second node Nb may not be changed. Therefore, when the (i+3)th carry signal CRi+3 shifts from a high level to a low level in the i+5th horizontal period Pi+5, the voltage of the second node Nb is sufficiently lower than the voltage of the first node Na so that the visibility of the pixel PXij may be increased. A display device having such a configuration divides one pixel into two sub-pixels, so that side visibility may be extended. Especially, by minimizing the influence of a coupling capacitance between a liquid crystal capacitor of a sub-pixel and peripheral gate lines, the reliability of a display device may be increased.

Although the exemplary embodiments of the present inventive concept have been described, it is understood that the present application and the appended claims should not be limited to these exemplary embodiments, as various changes and modifications can be made by one ordinary skilled in the art within the spirit and scope of the present inventive concept as hereinafter claimed.

What is claimed is:

1. A display device comprising:

a display panel comprising a plurality of pixels respectively connected to a plurality of gate lines and a plurality of data lines;

a gate driving circuit configured to generate a plurality of gate signals to the plurality of gate lines; and a data driving circuit configured to generate a plurality of data signals to drive the plurality of data lines, wherein each of the plurality of pixels comprises at least two sub-pixels in which a first sub-pixel is configured to receive a corresponding data signal among the plurality of data signals in response to a first gate signal output by the gate driving circuit, and a second sub-pixel is configured to receive a corresponding data signal among the plurality of data signals in response to the first gate signal, and reduce a voltage of the received data signal in response to a second gate signal output by the gate driving circuit, wherein the second gate signal is delayed by a 2×d×H time relative to the first gate signal, where d and H are positive integers, H is a horizontal period, and d×H is a pulse width of the first gate signal and the second gate signal, and wherein when a pulse width of the first gate signal and the second gate signal is 2×H, if the first gate signal comprises an i-th gate signal among the plurality of gate signals, the second gate signal comprises an (i+4) th gate signal.

2. The display device of claim 1, wherein the first sub-pixel comprises:

a first switching transistor comprising a first electrode connected to a corresponding data line driven by the data driving circuit, a second electrode connected to a first node, and a gate electrode connected to a corresponding first gate line driven by the gate driving circuit;

a first liquid crystal capacitor connected between the first node and a first common electrode for receiving a common voltage; and a first storage capacitor connected between the first node and a storage electrode for receiving a storage voltage.

3. The display device of claim 1, wherein the second sub-pixel comprises;

a second switching transistor comprising a first electrode connected to a corresponding data line driven by the data driving circuit, a second electrode connected to a second node, and a gate electrode connected to a corresponding first gate line driven by, the gate driving circuit;

a second liquid crystal capacitor connected between the second node and a second common electrode for receiving a common voltage;

a second storage capacitor connected between the second node and a storage electrode for receiving a storage voltage;

a third switching transistor comprising a first node connected to the second node, a second electrode connected to a third node, and a gate electrode connected to a second gate line driven by the gate driving circuit; and a pull-down capacitor connected between the third node and the storage electrode to reduce a voltage of the second node.

4. The display device of claim 3, wherein when a pulse width of the first gate signal and the second gate signal is 2×H, if the first gate line is an i-th gate line among the plurality of gate lines, the second gate line is an (i+4)th gate line.

5. The display device of claim 3, wherein when a pulse width of the first gate signal and the second gate signal is 4×H, if the first gate line is an i-th gate line among the plurality of gate lines, the second gate line is an (i±$)th gate line.

6. The display device of claim 1, further comprising a driving controller that outputs control signals to the gate driving circuit and the data driving circuit based on received image data.

7. The display device of claim 6, wherein the driving controller receives image data and corresponding command signals from an external graphic control unit.

* * * * *